US006575545B2

(12) United States Patent
Bruch et al.

(10) Patent No.: US 6,575,545 B2
(45) Date of Patent: Jun. 10, 2003

(54) IMPACT REDUCTION OF SLEW DECAP BY MULTI-DOTTING

(75) Inventors: Xavier Bruch, Barcelona (ES); John A Underwood, Vancouver, WA (US); Ramon Vega, Barcelona (ES)

(73) Assignee: Hewlett-Packard Company, Fort Collins, CO (US)

( * ) Notice: Subject to any disclaimer, the term of this patent is extended or adjusted under 35 U.S.C. 154(b) by 0 days.

(21) Appl. No.: 09/942,621

(22) Filed: Aug. 31, 2001

(65) Prior Publication Data

US 2003/0048316 A1 Mar. 13, 2003

(51) Int. Cl.[7] ..... B41J 24/38
(52) U.S. Cl. ..... 347/12; 347/14
(58) Field of Search ..... 347/12, 15, 43, 347/20

(56) References Cited

U.S. PATENT DOCUMENTS 5,610,637 A * 3/1997 Sekiya et al. ..... 347/10
6,193,347 B1 * 2/2001 Askeland et al. ..... 347/15
6,264,298 B1 * 7/2001 Mantell ..... 347/15
6,281,913 B1 * 8/2001 Webb ..... 347/46
6,290,329 B1 * 9/2001 Terasawa et al. ..... 347/43

* cited by examiner

*Primary Examiner*—Thinh Nguyen
*Assistant Examiner*—Alfred E Dudding

(57) ABSTRACT

A method, a computer readable medium and an apparatus for reducing the impact of slew decap on image quality in a printing system is disclosed. In one respect, the invention pertains to a method for reducing the impact of slew decap on image quality in a printing system includes a printhead. The printhead includes a nozzle and the nozzle is configured to fire ink on a print medium. The ink is operable to produce a pixel on the print medium. The method includes producing a pixel with the nozzle. The pixel is produced by multi-dotting. Multi-dotting includes firing ink multiple times in succession from the nozzle at a pixel location corresponding to the pixel. In another respect, the invention pertains to a computer readable medium on which is embedded computer software comprising a set of instructions for performing the above method. In yet another respect, the invention utilizes an apparatus configured perform the above method.

36 Claims, 7 Drawing Sheets

IMPACT REDUCTION OF SLEW DECAP BY MULTI-DOTTING

FIELD OF THE INVENTION

This invention relates generally to inkjet printers, and more particularly to operations performed by a printhead of an inkjet printer to reduce slew decap effects.

BACKGROUND OF THE INVENTION

It is generally known that inkjet printers utilize at least one printhead possessing a plurality of nozzles through which ink drops are fired onto a medium, e.g., fabric, paper, etc., to create an image on the medium, e.g., plot, drawing, etc. According to one type of inkjet printer, ink is typically supplied substantially continuously over a plurality of resistors generally located beneath the openings of the nozzles. In use, certain of the resistors are activated, i.e., heated, to vaporize a portion of the ink on the resistors, thereby causing a portion of the ink to be fired through the respective nozzle openings. According to another type of inkjet printer, ink is typically supplied substantially continuously over a plurality of piezoelectric elements located beneath the openings of the nozzles. In this type of printer, certain of the piezoelectric elements are caused to deform at a relatively rapid rate, thereby causing ink positioned thereover to be fired through the respective nozzle openings to produce pixels.

To create an image on the print medium, the printer typically controls the nozzles to produce a pattern of pixels corresponding to the image. The nozzles are generally arranged on one or more printheads that travel back and forth across the surface of the print medium. In this regard, FIG. 1 schematically illustrates a part of a known printer device (e.g., a large format inkjet printer) having an array of printheads 100 in a parallel row. More specifically, FIG. 1 illustrates six printheads 102–112. Each of the printheads 102–112 includes a plurality of printer nozzles (not shown) for firing ink 114, 116 onto a print medium 120. Although FIG. 1 depicts the printer device as having six printheads 102–112, printer devices have been known to possess any number of printheads, e.g., two, four, or more.

The printheads 102–112 are typically constrained to slew back and forth or move in a direction 170 with respect to the print medium 120, e.g., paper, textile, and the like. In addition, the print medium 120 is also constrained to move in a further direction 160. During a normal print operation, the printheads 102–112 are moved into a first position with respect to the print medium 120 and a plurality of ink droplets 114, 116 are fired from the same plurality of printer nozzles contained within each of the printheads 102–112. After completion of a print operation, the printheads 102–112 are moved in a direction 170 toward a second position and another print operation is performed. In a like manner, the printheads 102–112 are repeatedly moved in a direction 170 across the print medium 120 and a print operation is performed after each such movement of the printheads 102–112. When the printheads 102–112 reach an edge of the print medium 120, the print medium is typically moved a short distance in a direction 160, parallel to a main length of the print medium 120, and another print operation is performed. The printheads 102–112 are then moved in a direction 170 back across the print medium 120 and yet another print operation is performed. In this manner, a complete printed page may be produced.

A more detailed description of the printer device illustrated in FIG. 1 may found in commonly assigned application Ser. No. 09/502,667 filed on Feb. 11, 2000, by Xavier Bruch et al., the disclosure of which is hereby incorporated by reference in its entirety.

As the printheads 102–112 move or slew, they create a current of air across the uncapped (or decapped) nozzles of the printheads 102–112. Slew decap is a term of art used to identify this phenomenon in which the current of air causes evaporation of a solvent vehicle component of the ink. In general, evaporation of the solvent vehicle alters the chemical composition of the ink. More particularly, the change in chemical composition results in a less visible drop of ink on the print medium 120. For example, evaporation may cause dye or pigment molecules to move from the nozzle, back into the firing chamber and thus diluting the solvent vehicle. Additionally, the rate of chemical change is relatively greater with lower drop volumes. Thus, as drop volumes generally decrease in order to improve image quality, the effects of slew decap may worsen.

In order to maintain the quality of the printed output, it is generally known to maintain the nozzles in substantially proper operating condition. In this respect, a service station 140 is typically provided along a travel path of the printheads 102–112. The service station 140 is typically configured to maintain the health of the printheads 102–112 by performing servicing operations on the printheads, e.g., a means for wiping, collecting spit ink, capping the nozzles, etc. The service station 140 typically includes a plurality of service station units 142–152 for performing servicing operations on each of the printheads 102–112. Generally speaking, a respective service station unit 142–152 is provided for each of the printheads 102–112. The service station units 142–152 are typically housed within a service station frame 154.

A servicing protocol is typically implemented to control the times and manner in which the printheads 102–112 are serviced. For example, in one respect, if it is detected that certain of the nozzles of the printheads 102–112 have not fired any ink drops for a certain period of time, the printheads are moved to a position over the service station 140 and caused to fire a normally set number of ink drops to thereby clean out the nozzles. In addition, a wiping mechanism positioned in the service station 140 may be caused to wipe excess ink off the nozzles to thereby increase the probability of their proper functionality. In another respect, the protocol may cause the printheads 102–112 to spit a set number of ink drops into the service station after each printing pass in an effort to substantially prevent ink from drying within the nozzles. The servicing protocol typically sets the number of times as well as the frequency of servicing operations based upon a set of normal values which are themselves typically set by the printhead or service station manufacturer. In addition, the normal values of the servicing protocol may vary according to the set printmodes. In general, servicing operations require some time to perform and thus decrease throughput.

The above-described servicing process is generally known as an open loop servicing technique. That is, the servicing protocol that determines when to service the printheads 102–112 as well as the degree of servicing to be applied, takes into consideration certain variables, e.g., time uncapped, drops fired during last printing pass, time in cap, etc. However, these types of servicing protocols typically apply a relatively heavy treatment to greater ensure proper printhead performance regardless of the age of the printheads 102–112. One problem associated with the open loop servicing technique is that ink may be wasted by virtue of spitting more ink drops than is necessary, oftentimes resulting in faster aging of the printheads as well as the service station.

Printer devices have also been known to include a drop detector module 130 operable to detect whether the nozzles of the printheads 102–112 are properly firing ink. In these types of printer devices, servicing operations on the printheads 102–112 may be triggered by detected errors, e.g., clogged nozzles, and a user's expectations, e.g., desired print quality. It is generally known to position the printheads 102–112 over the service station 140 and spit a certain number of ink drops to clean out the ink in the nozzles. This servicing process is generally known as a closed loop servicing technique. That is, servicing on the printheads 102–112 may occur based upon a closed loop servicing protocol under normal operating conditions, with extra, possibly lighter, servicing operations being performed based upon detected errors, e.g., clogged nozzles. In this regard, the closed loop servicing technique has certain advantages over the open loop servicing technique (e.g., does not waste a relatively large amount of ink, extends the life of the printheads and service station, etc.). However, printer devices that implement the closed loop servicing technique are relatively more expensive and complicated and thus may be unsuitable for certain types of printers (e.g., less expensive printer models).

In addition to the servicing operations, the printing device is generally configured to produce print content (e.g., text, image, etc.) on the print medium in response to receiving a print job. In this regard, the printing device references the print job to produce the print content by generating a plurality of pixels.

While a pixel is often thought of as a physical dot on a print medium, for the purpose of this disclosure, a pixel is defined as a physical dot on a print medium and/or the corresponding logical location utilized by the printing device to determine where the dot should be placed. For example, in response to receiving the print job, the printer determines specific commands. The specific commands may denote each location a pixel is to be positioned on the print medium.

In FIGS. 2A and 2B, there is illustrated a manner in which slew decap may impact a conventional image printing operation 200. As shown in FIG. 2A, a grid 210 depicts a number of greatly magnified logical pixel locations. Within the grid 210, a number of dots 220 depict pixels printed in particular pixel locations. The image the dots 220 form is a plus sign. Due to the fact that the dots 220 are clearly visible and not miss-formed, it is apparent that nozzles used to create the dots 220 have been fired recently enough so that substantially no slew decap effects are evident.

As is shown in FIG. 2B, a grid 230 illustrates the effect of slew decap while printing substantially the same plus sign as depicted in the grid 210. Similarly to the dots 220, a number of dots 240 are shown. Additionally, as illustrated by a number of miss-formed dots 250, sufficient time and/or distance has elapsed to cause slew decap associated problems. For example, as the printhead moved from right to left during the printing of the dots 240 and 250, slew decap occurred in, at least, the one or more nozzles used to create the dots 240 and miss-formed dots 250. Thus, as shown in the grid 230, the image formed by the dots 240 is substantially a minus sign.

Although FIGS. 2A and 2B depict a pixel being produced by a single dot, in a similar manner, pixels formed by a plurality of dots, wherein the plurality of dots are produced by a plurality of nozzles, may also be affected by slew decap. Additionally, while FIG. 2B depicts a miss-formed dot being produced following a period or distance in which no ink was fired, in fact, ink may be fired by one or more printer nozzles other than the printer nozzle used to produce the miss-formed dot without departing from the scope of the invention.

SUMMARY OF THE INVENTION

In one respect, the invention pertains to a method for reducing the impact of slew decap on image quality in a printing system. The method includes a printhead. The printhead includes a nozzle and the nozzle is configured to fire ink on a print medium. The ink is operable to produce a pixel on the print medium. The method includes producing a pixel with the nozzle. The pixel is produced by multi-dotting during a single printing pass. Multi-dotting includes firing ink multiple times in succession from the nozzle at a pixel location corresponding to the pixel.

In another respect, the invention pertains to a computer readable medium on which is embedded computer software. The computer software includes a set of instructions for reducing the impact of slew decap on image quality in a printing system includes a printhead. The printhead includes a nozzle and the nozzle is configured to fire ink on a print medium. The ink is operable to produce a pixel on the print medium. The method includes producing a pixel with the nozzle. The pixel is produced by multi-dotting during a single printing pass. Multi-dotting includes firing ink multiple times in succession from the nozzle at a pixel location corresponding to the pixel.

In yet another respect, the invention utilizes an apparatus for operating a printer. The apparatus includes a printhead. The printhead includes a nozzle. The apparatus includes a controller configured to receive a print job and to modify the print job. The modification includes a command to produce a pixel by multi-dotting during a single printing pass. Multi-dotting includes firing ink multiple times in succession from the nozzle at a pixel location corresponding to the pixel. Further, the nozzle is operable to produce the pixel by multi-dotting in response to the modified print job.

In comparison to known prior art, certain embodiments of the invention are capable of achieving certain aspects, including some or all of the following: (1) increase image quality; (2) increase throughput; and (3) save resources. Those skilled in the art will appreciate these and other aspects of various embodiments of the invention upon reading the following detailed description of a preferred embodiment with reference to the below-listed drawings.

DETAILED DESCRIPTION OF A PREFERRED EMBODIMENT

For simplicity and illustrative purposes, the principles of the invention are described by referring mainly to an exemplary embodiment thereof, particularly with references to an inkjet printing system. However, one of ordinary skill in the art would readily recognize that the same principles are equally applicable to, and may be implemented in, a system capable of printing a plurality of pixels or dots to create an image, and that any such variations are within the scope of the invention. While in the following description numerous specific details are set forth in order to provide a thorough understanding of an embodiment of the invention, in other instances, well known methods and structures have not been described in detail so as not to obscure the invention.

Figure 1:
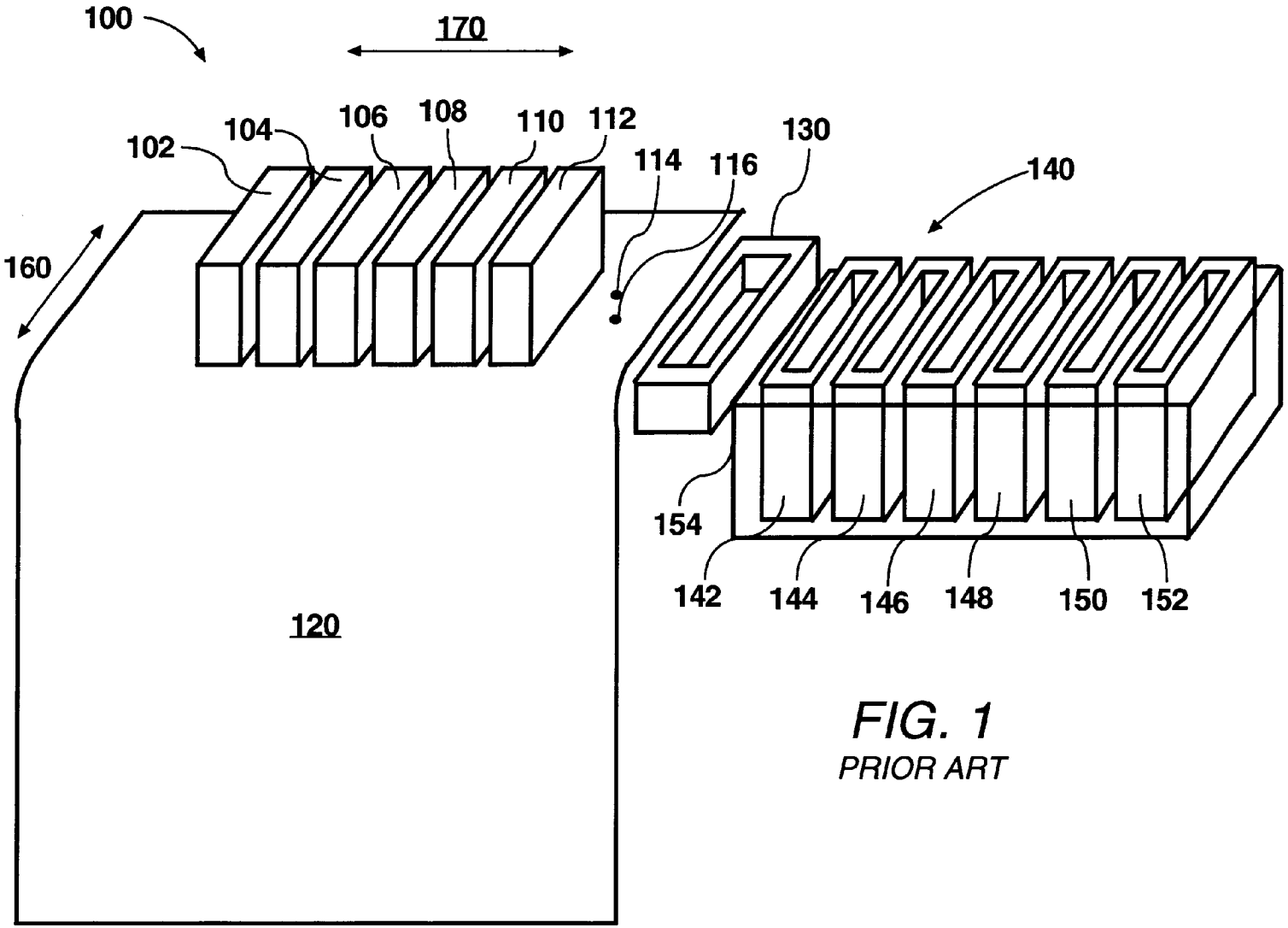
FIG. 1 PRIOR ART
FIG. 1 illustrates a schematic diagram of a conventional printer device showing a manner in which a set of print heads are manipulated with respect to other components of the printer device.
Figure 2A:
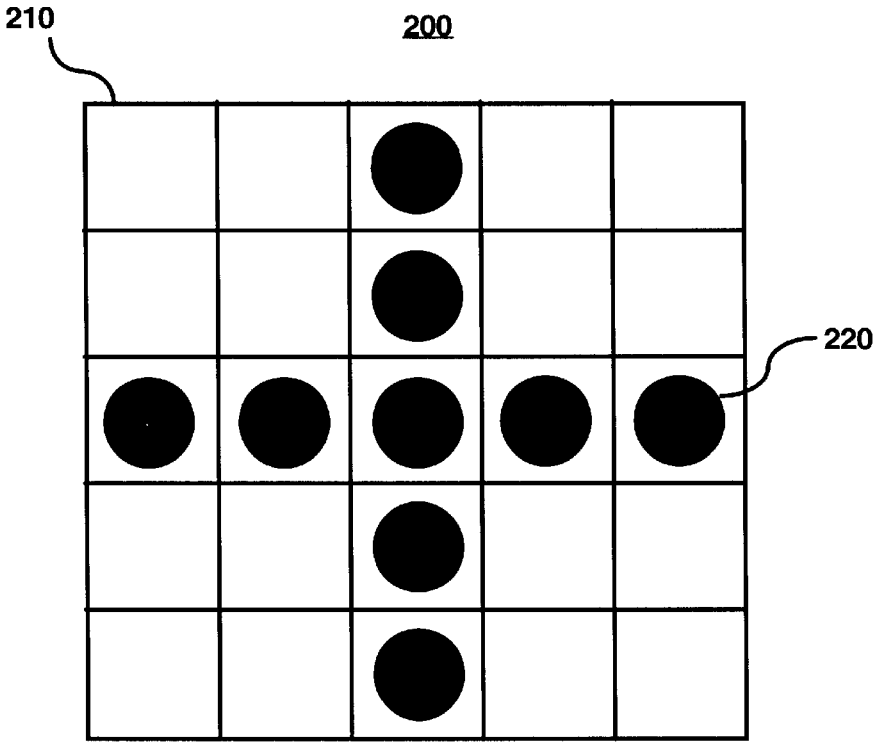
FIG. 2A PRIOR ART
FIGS. 2A and 2B illustrate a manner in which slew decap may affect a conventional image printing operation.
Figure 2B:
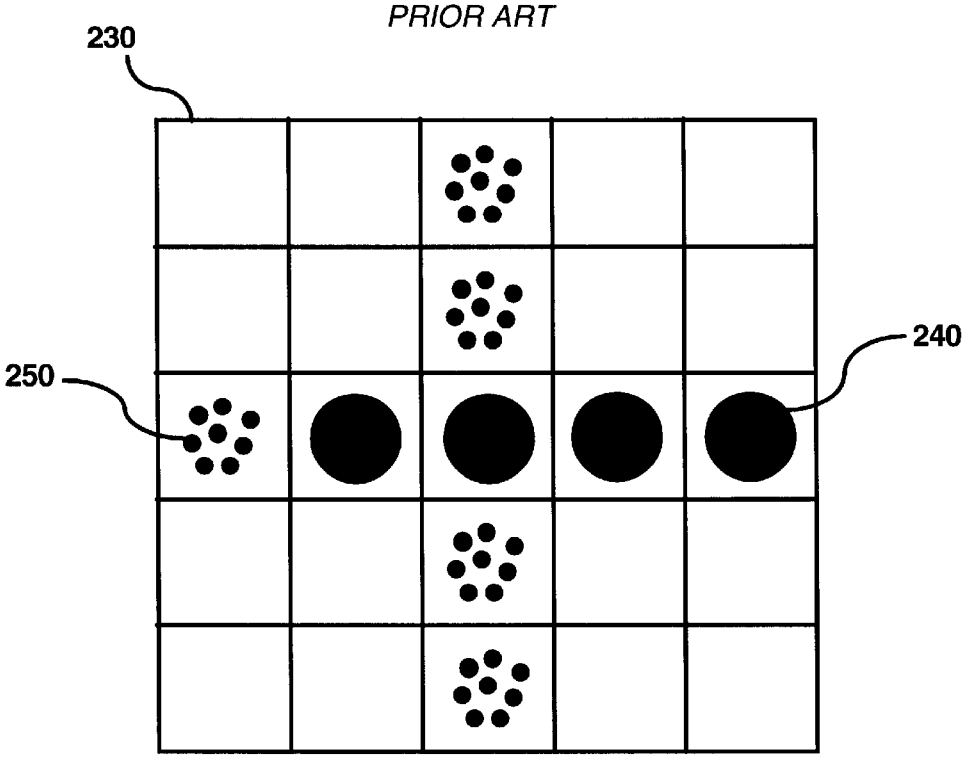
FIG. 2B PRIOR ART
Figure 3:
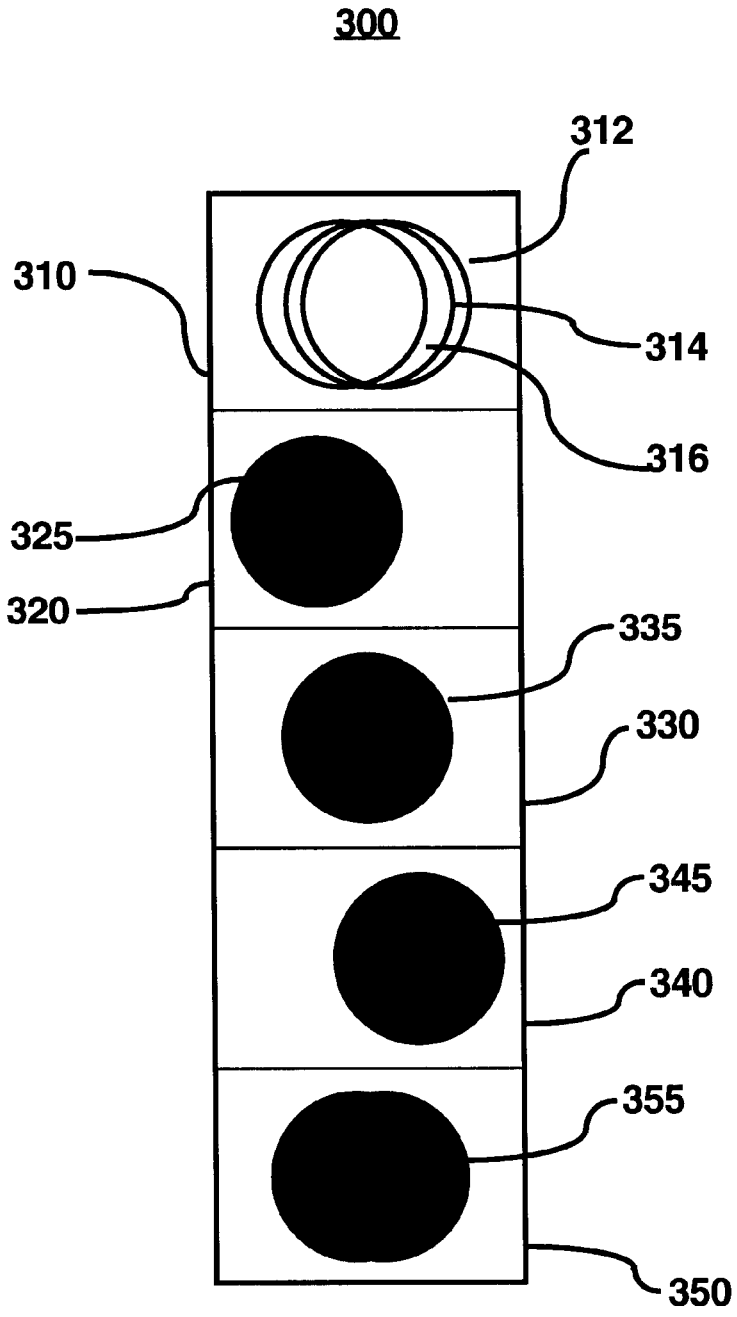
FIG. 3 illustrates an exemplary manner in which a plurality of dots may be produced in a single logical pixel location according to an embodiment of the invention.

FIG. 3 illustrates an exemplary manner of printing operation 300 in which a plurality of dots may be produced in a single logical pixel location according to an embodiment of the invention. FIG. 3 includes pixel locations 310, 320, 330 and 340. Pixel location 310 illustrates a number of possible dot placements 312, 314 and 316 that may be produced by a single print nozzle during a single pass of the printhead. For example, at a typical printhead slew rate of twenty (20) inches per second ("ips") and a typical print nozzle firing rate of thirty six thousand cycles per second, ("36 kHz") the print nozzle may be capable of firing three (3) times in a distance of approximately one thousandth of an inch (0.001 inch).

Pixel locations 320, 330 and 340 depict another way of illustrating a number of possible dot placements within a pixel location. For example, a dot 325 within pixel location 320 is shown relatively further to the left side of its respective pixel location than a dot 335 in pixel location 330. Furthermore, the dot 335 is shown to be relatively further to the left side of its respective pixel location than a dot 345 within pixel location 340. FIG. 3 further illustrates a dot 355 within a pixel location 350. The dot 355 illustrates an exemplary form of how a pixel produced by a plurality of slightly offset dots may appear. While the dot 355 appears somewhat elongated, it should be noted that in actual practice multi-dotting may be performed when it is reasonable to expect the first dot will be miss-formed and thus the elongation may be less visible. Additionally, the size of an actual pixel is relatively small and a slight elongation may be undetectable by the naked eye. Furthermore, the dot 355 is an example of a pixel produced with multiple dots and thus, the elongation may be exaggerated for illustrative purposes.

While three dots within a pixel location are shown in FIG. 3, the invention is not limited to three dots within a pixel location but rather, the invention may include any reasonable number of dots. In general, the number of dots will depend on the slew rate of the printhead, the firing rate of the respective print nozzle, and the dimensions of the pixel location. In this regard, for the purpose of this disclosure, the term multi-dotting refers to the process of firing ink a plurality of times in succession from a nozzle at a pixel location to produce a pixel.

Additionally, while FIG. 3 illustrates black dots produced with black ink, it is widely known that dots of other colors may be produced. Furthermore, pixels may be produced in a relatively large number of colors via a method known to those of ordinary skill in the art as process or rendered color (e.g., rendered gray, rendered orange, etc.). To produce a rendered pixel, a plurality of dots are fired at a pixel location. The plurality of dots include a subset of dots with at least one different color. In this manner, millions of color variations may be produced with some combination of colors (e.g., cyan, yellow, magenta and black).

Figure 4:
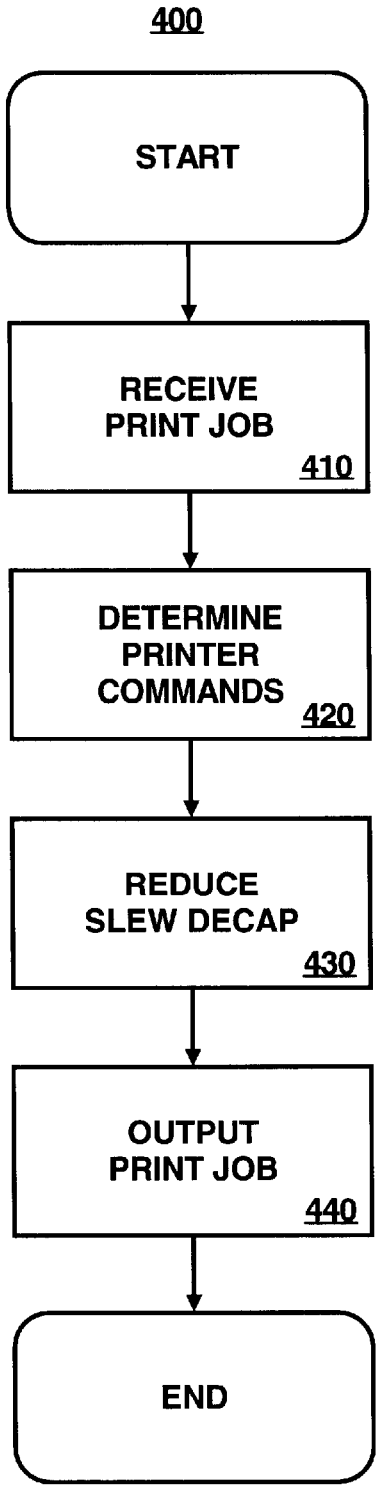
FIG. 4 is a flow chart of a method according to an embodiment of the invention.

FIG. 4 is a flow chart of a method 400, according to an embodiment of the invention. The method 400 includes a step 410 of receiving a print job, a step 420 of determining printer commands, a step 430 of reducing slew decap and a step 440 of outputting the printjob. The method 400 may exist in a variety of forms, several of which are described below.

As depicted in FIG. 4, the method 400 is initiated in response to receiving a print job in step 410. The print job is typically initiated by a user operating a computer or terminal on the local area network ("LAN") in which a printer is located. However, it is within the scope of this invention that the print job may be received in any manner known to those skilled in the art. For example, the printer may be directly attached to a computer. Furthermore, it is within the scope of this invention that the printer and the print job input device (e.g., keyboard, scanner, etc.) is a single device. For example, an electronic typewriter and/or "all in one device", such as a printer/copier/fax machine.

In step 420, in a manner known to those skilled in the art, the print job may be converted into a stream of data corresponding to printer specific commands generated in response to the print job. In general, the printer specific commands may include commands associated with media movement, printhead movement, nozzle firing, etc.

In step 430, the impact of slew decap may be reduced. In one form, slew decap may be reduced by multi-dotting to produce essentially every pixel. Generally, pixels may be produced with a plurality of dots fired during a plurality of passes. In a preferred form, a pixel that has been multi-dotted during one printing pass may not be fired at during a second printing pass. For example, during one printing pass, the printer specific commands may be referenced and essentially every nozzle firing command may be duplicated. Each duplicated command may be inserted substantially directly behind (or in front of) the corresponding original nozzle firing command. During a second printing pass, essentially every nozzle firing command may be removed. In this manner, the printer specific commands may be modified. While in the above example, essentially all pixels are multi-dotted in one pass and not dotted in a second pass, the invention is not limited to the above example, but rather, a subset of pixels may be multi-dotted in one pass (e.g., every other pixel, every third pixel, etc.) and some subset of the remaining pixels may be multi-dotted in a second pass. Thus, if sufficient time and/or distance has elapsed since a nozzle has fired to cause the problems associated with slew decap, the first dot will be miss-formed, however, a subsequent dot may correct the error. While multi-dotting may slightly elongate a dot, as shown in FIG. 3, the method 400 may be capable of producing the dot substantially within the corresponding pixel location.

In this form, the method 400 may utilize relatively less ink and the throughput may be increased. In this regard, the number of printhead servicing events may be reduced, thus, saving time and ink.

In step 440, the modified printer specific commands may be forwarded or utilized to produce the print job. In a process known to those skilled in the art, the modified printer specific commands may be utilized to control the movements and operations of the printer. Following step 440 and the completion of the print job, the method 400 ends.

Figure 5:
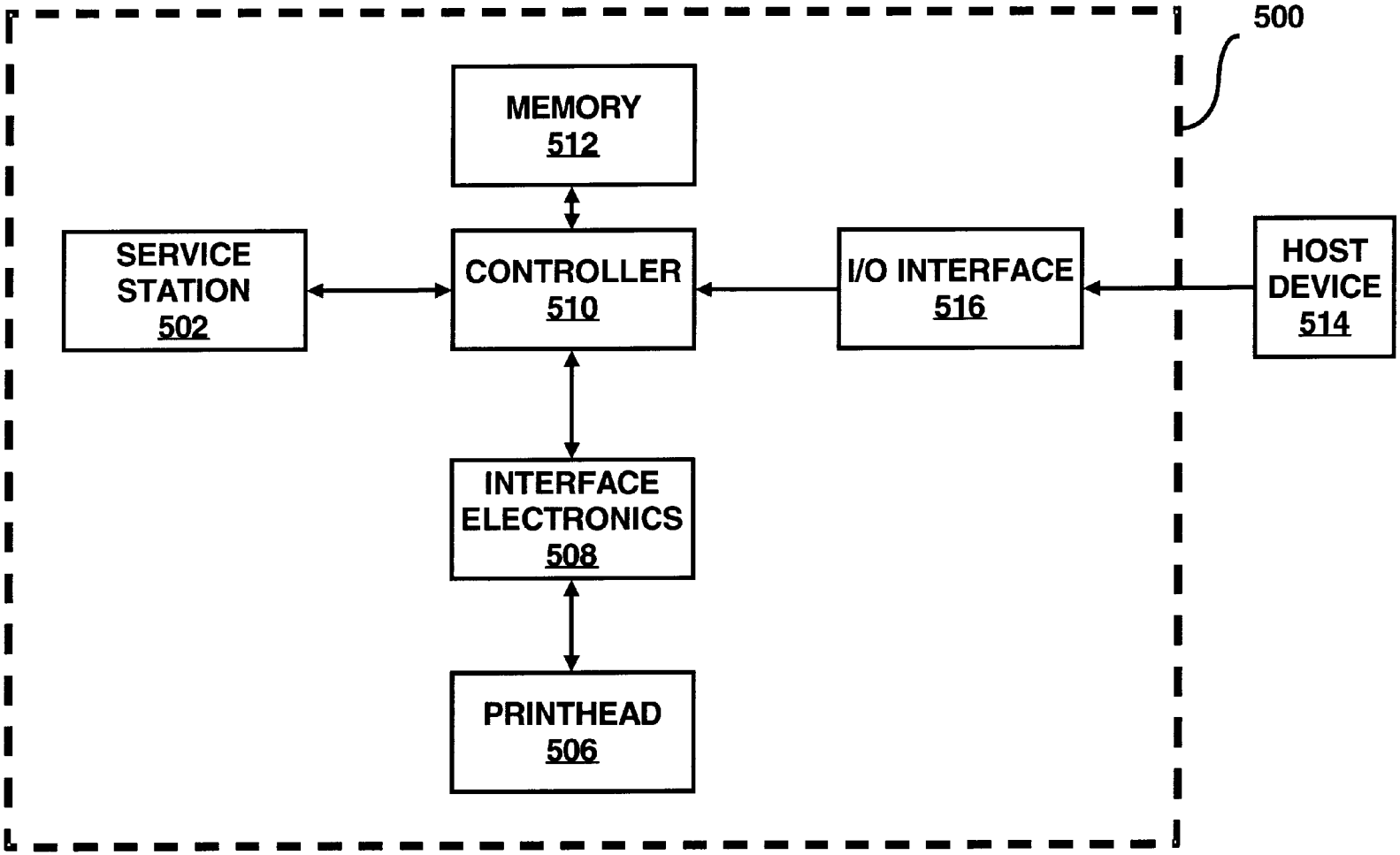
FIG. 5 is a block diagram of a system according to an embodiment of the invention.

Referring to FIG. 5, there is illustrated an exemplary block diagram of a printer 500 in accordance with the principles of the present invention. The following description of the block diagram illustrates one manner in which a printer 500 having a service station 502 may be operated in accordance with the principles of the present invention. In this respect, it is to be understood that the following description of the block diagram is but one manner of a variety of different manners in which such a printer may be operated.

Generally speaking, the printer 500 includes a printhead 506, although a plurality of printheads may be included. The description of one printhead 506 in the present disclosure is for purposes of simplicity and is not meant as a limitation. In this regard, the printer 500 may include any reasonably suitable number of printheads, e.g., two, four, six, and the like, configured to operate in the manner described hereinbelow with respect to the printhead 506. In addition, the printer 500 is illustrated and described in terms of a large format inkjet printer; however, it should be understood and readily apparent to those skilled in the art that the multi-dotting technique disclosed herein may be implemented in any reasonably suitable type of printer without departing from the scope of the invention.

The printhead 506 may be configured to repeatedly pass across a medium in individual, horizontal swaths or passes during a printing operation to print a particular image (e.g., picture, text, diagrams, etc.) onto the medium. In addition, the printhead 506 may be configured to contain a plurality of nozzles (not shown) operable to be implemented during each pass to apply an ink pattern onto the medium and thus print the particular image. In this regard, the printhead 506 may comprise a conventional thermal inkjet printhead or a conventional piezoelectric printhead, both of which are generally known to those skilled in the art.

The printer 500 may also include interface electronics 508. The interface electronics 508 may be configured to provide an interface between a controller 510 of the printer 500 and the components for moving the printhead 506, e.g., a carriage, belt and pulley system (not shown), etc. The interface electronics 508 may include, for example, circuits for moving the printhead 506, moving the medium, firing individual resistors or piezoelectric elements in the nozzles of the printhead, and the like.

The controller 510 may be configured to provide control logic for the printer 500, which provides the functionality for the printer. In this respect, the controller 510 may possess a microprocessor, a micro-controller, an application specific integrated circuit, and the like. The controller 510 may be interfaced with a memory 512 configured to provide storage of a computer software that provides the functionality of the printer 500 and may be executed by the controller. The memory 512 may also be configured to provide a temporary storage area for data/file received by the printer 500 from a host device 514, such as a computer, server, workstation, and the like. The memory 512 may be implemented as a combination of volatile and non-volatile memory, such as dynamic random access memory ("RAM"), EEPROM, flash memory, and the like. It is also within the purview of the present invention that the memory 512 may be included in the host device 514.

The controller 510 may further be interfaced with an I/O interface 516 configured to provide a communication channel between a host device 514 and the printer 500. The I/O interface 516 may conform to protocols such as RS-232, parallel, small computer system interface, universal serial bus, etc. In addition, the controller 510 may be interfaced with the service station 502.

Although the host device 514 is depicted as distinct from the printer 500, it is widely known that the functionality of the host device 514 may be subsumed within the printer 500. For example, an electronic typewriter or a printer/scanner/fax/copier machine may incorporate some or all of the functionality of the host device 514 within the printer 500. Although not depicted in FIG. 5, the printer 500 and/or the host device 514 may include a user interface. The user interface may be configured to provide the capability to select a printmode, media type, etc.

Figure 6:
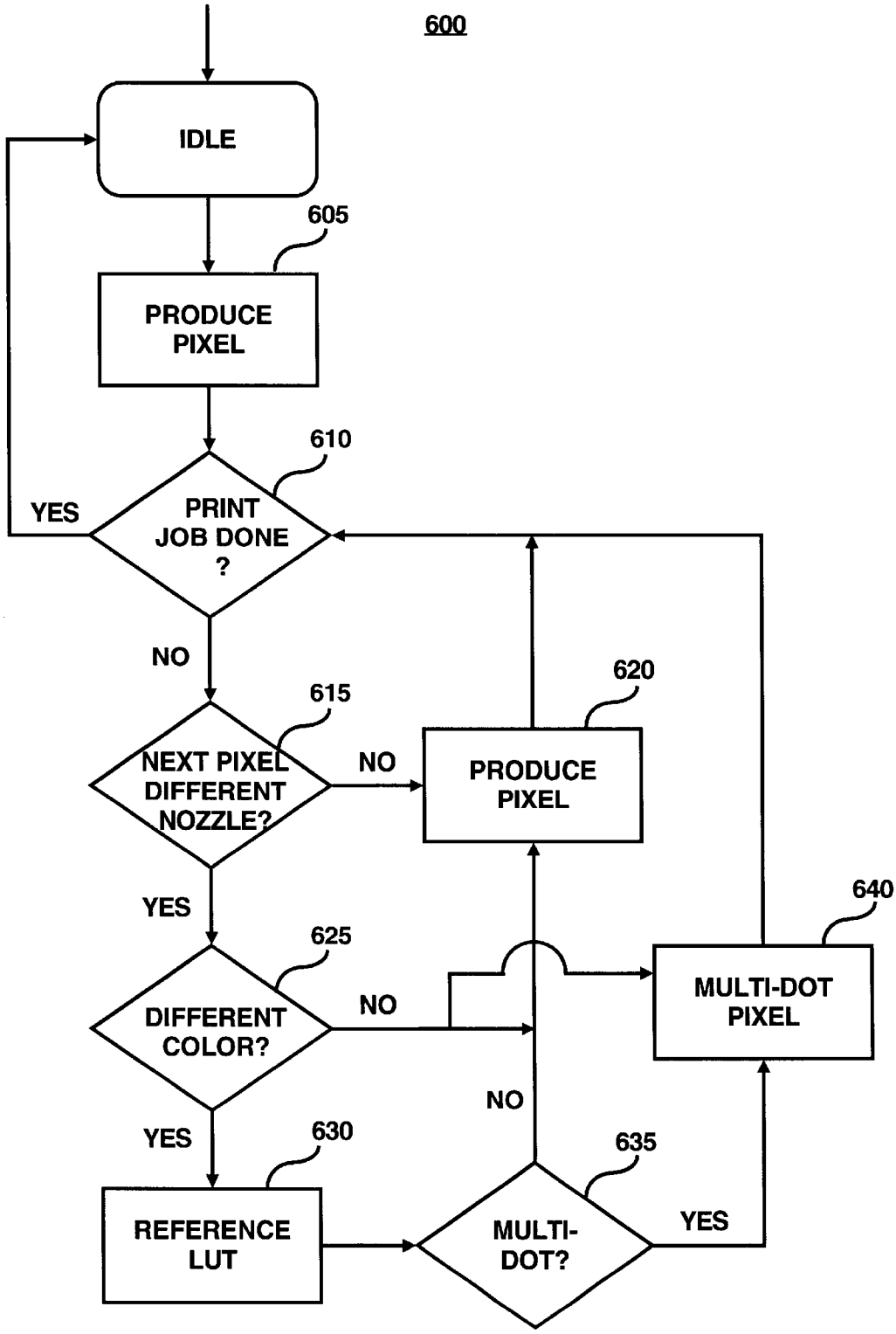
FIG. 6 is a flow chart of a method according to another embodiment of the invention.

FIG. 6 is a flow chart of a method 600 according to another embodiment of the invention. As shown in FIG. 6, the impact of slew decap may be reduced by multi-dotting at the edge of a printed color. The method 600 is similar to the method 400 described above and thus, only those steps that differ will be described below. For example, although not shown in FIG. 6, in a manner similar to the method 400, a print job is received, printer specific commands are generated and, in response to the printer specific commands, printing may be initiated.

Typically, the method 600 remains in an idle step until a command to print is received. In this regard, in step 605, in response to receiving a command to print a fist pixel, the first pixel is produced by, at least, a first nozzle. For example, at least one dot fired by the first nozzle is utilized to produce the first pixel. Following the step 605, the method 600 proceeds to step 610.

In step 610, the controller may reference the printer specific commands to determine if the print job is done. If it is determined that the print job is done, the method 600 may proceed to the idle step. If it is determined that the printjob is not done, the method 600 may proceed to step 615.

In step 615, the controller may reference the printer specific commands to determine if a next pixel is to be produced by, at least, the first nozzle. If it is determined that the first nozzle is utilized to produce the next pixel, the method 600 may proceed to step 620. If it is determined that the first nozzle is not utilized to produce the next pixel, the method 600 may proceed to step 625.

In step 620, the printer specific command to produce the next pixel may be utilized to produce the next pixel. Following the step 620, the method 600 may return to the step 610.

In step 625, the controller may reference the printer specific commands to determine if the next pixel is a different color from the first (or previous) pixel. In one form, if it is determined that the next pixel is substantially the same color, the method 600 may proceed to step 620. In another form, if it is determined that the next pixel is substantially the same color, the method 600 may proceed to step 640. In either form, if it is determined that the next pixel is a different color, the method 600 may proceed to step 630.

In step 630, the controller may reference the color of the previous and next pixel. The controller may further reference a look up table ("LUT") to determine a response for the transition of color. Depending on the colors involved in the transition, the perceived or actual slew decap defects may be more or less pronounced. The LUT may include colors or ranges of colors transitioned from and/or transitioned to. The LUT may further include a proscribed response for each color transition. For example, the LUT may stipulate that during a transition from yellow to black, the first three black pixels are multi-dotted. In order to clarify the use of the LUT, Table 1 shows an exemplary LUT according to an embodiment of the invention.

TABLE 1

| Line # | Color from | Color to | Multi-dots/Pixel | No. of Multi-dot Pixels |
|---|---|---|---|---|
| 1 | Black | Light Green | 1 | 1 |
| 2 | Black | Green | 1 | 2 |
| 3 | Black | Dark Green | 2 | 2 |
| 4 | Light Green | Black | 2 | 2 |
| 5 | Green | Black | 2 | 3 |
| 6 | Dark Green | Black | 2 | 5 |
| 7 | Any Color | No Color | 0 | 0 |

As shown in Table 1, in line 1, during the transition from black to light green, one pixel is double-dotted (i.e., each original dot is duplicated once). In general, the impact of slew decap may be relatively more visible in a transition to a darker color. Thus, as is further shown in Table 1, as the "Color to" becomes darker in line 2 and 3, the severity of the multi-dotting response may become greater. Additionally, the impact of slew decap may be particularly more visible in a transition to black due to ink chemistry of black ink. In this regard, and as shown in lines 4, 5 and 6, the transition to black may require relatively more extensive multi-dotting. Furthermore, as shown in line 7, in the transition from any color to no color, no multi-dotting response may be require.

Returning to the description of FIG. 6, following step 630, the method 600 may proceed to step 635.

In step 635, based on the response indicated in the LUT, the method 600 may produce the next pixel by multi-dotting or not. For example, if the LUT indicates that essentially no multi-dotting response is required, the method 600 may proceed to step 620. However, if the LUT indicates that a multi-dotting response is required, the method 600 may proceed to step 640.

In step 640, the controller may duplicate the printer specific command associated with producing the next pixel. Based on the LUT, one or more duplicates may be generated. The duplicated command(s) may be inserted substantially adjacent to the original command. In this manner, the printer specific command associated with producing the next pixel may be modified. Additionally, in step 640, the next pixel may be produced by a second nozzle based on the modified printer specific command.

In one form, following the production of the next pixel, the method 600 may return to the step 610. In another form, the controller may reference the printer specific commands to determine if one or more subsequent pixels are to be produced by the second nozzle. Due to the relatively small size of a single pixel, typically, more than one pixel of a given color will be produced in a row. For example, a relatively thin line may be four or more pixels wide. Furthermore, a relatively wide printed element (e.g., a horizontal line etc.) may be produced by many hundreds or thousands of pixels. In this regard, the controller may determine a number for how many pixels in a row will be produced by the second nozzle. The controller may further reference the LUT to determine how many multi-dotted pixels to produce. Based on the pixels in a row and the LUT, the controller may instruct the second nozzle to produce additional multi-dotted pixels. For example, in line 6 of Table 1, for a transition from dark green to black, the LUT indicates that five multi-dotted pixels may be produced. If the second nozzle is to produce twenty pixels in a row, the controller may instruct the nozzle to produce a number of the twenty pixels as multi-dotted pixels. Furthermore, in step 640, the controller may reference the printer specific commands and modify one or more subsequent printing passes to essentially remove the printer specific commands associated with the multi-dotted pixel(s). Following the step 640, the method 600 may return to step 610.

The method 600 may improve printing throughput as well as reduce ink usage. For example, the number of printhead servicing events may be reduced, thus, saving time. Additionally, ink usage may be reduced due to the reduced number of printhead servicing events. Furthermore, only a small minority of pixels may be produced by multi-dotting.

Figure 7:
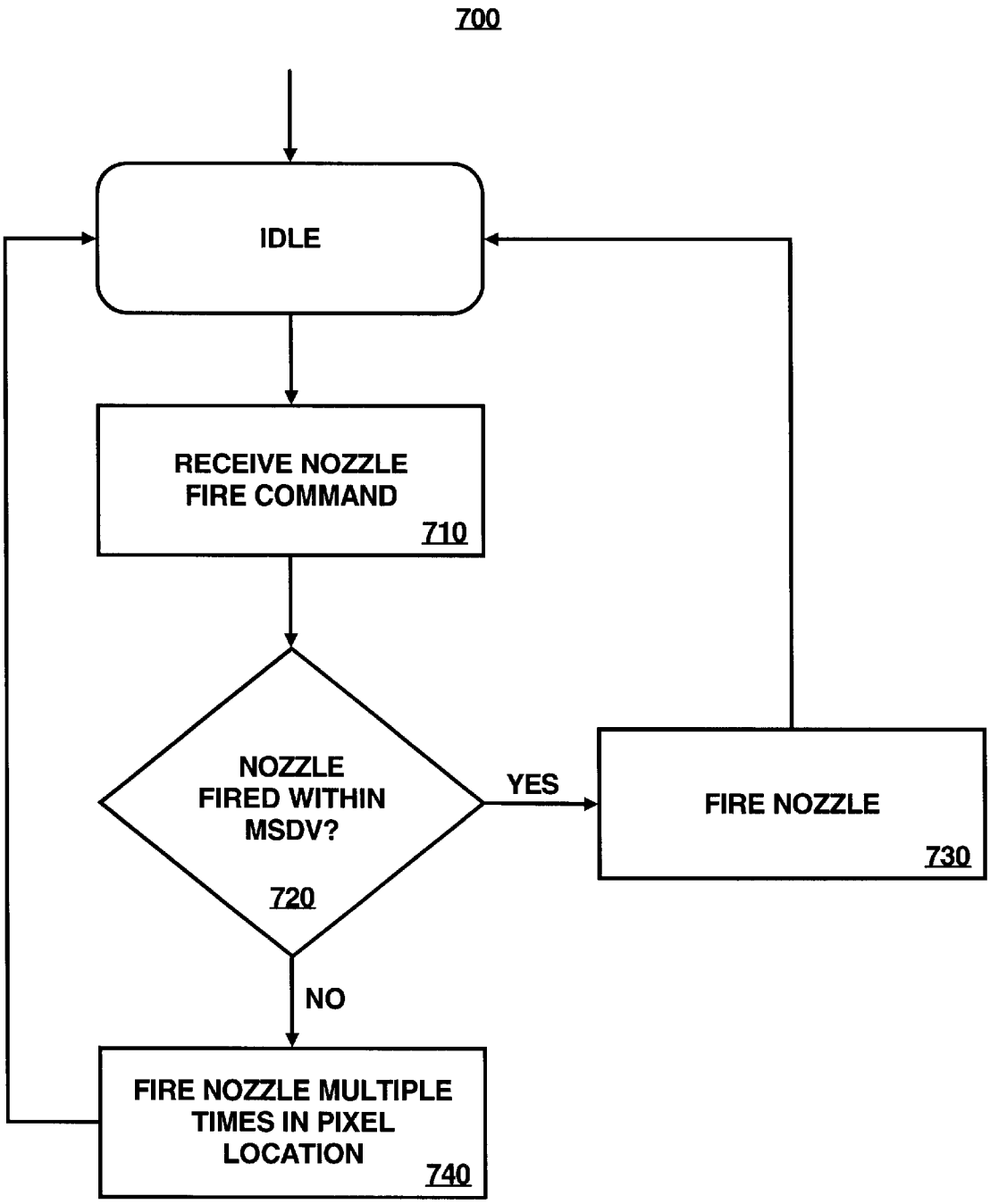
FIG. 7 is a flow chart of a method according to yet another embodiment of the invention.

FIG. 7 is a flow chart of a method 700 according to yet another embodiment of the invention. In the method 700, the impact of slew decap may be reduced by multi-dotting if a maximum slew decap value ("MSDV") is exceeded prior to the firing of a particular nozzle. The method 700 is similar to the above described method 400 and 600, only those steps that differ will be described below. Prior to initiation, the method 700 may wait to receive a command in an idle step.

Prior to or during the method 700, the MSDV may be determined based on a number of factors such as volume of ink fired, decap time, slew rate, printmode, ink chemistry, media, environmental factors, etc. In general, the MSDV may be determined based on the impact of slew decap has on image quality. Thus, in one form, the MSDV may be based on a selected printmode. Typically, when firing three to eighteen nanograms (3–18 ηg) of ink, slew decap times of greater than about one to two (1–2) seconds may begin to negatively effect image quality. In one form, the MSDV may be based on the printmode. For example, while printing in a relatively higher image quality printmode, a lower threshold value may be used to determine the MSDV.

In step 710, the method 700 may be initiated in response to receiving a nozzle fire command. Following step 710, the method 700 may proceed to step 720.

In step 720, the controller may determine if the nozzle has fired within the MSDV. For example, the printer specific commands may be referenced to determine when the nozzle was last fired. In another example, a timer may be initialized each time the nozzle is fired and this time may be compared to the MSDV. If it is determined that the nozzle has fire within the MSDV, the method 700 may proceed to step 730. If it is determined that essentially no command to fire the nozzle has occurred within the MSDV, the method 700 may proceed to step 740.

In step 730, the nozzle may fire based on the nozzle fire command. Following the step 730, the method 700 may return to the idle step to wait for the next command.

In step 740, the controller may duplicate the nozzle fire command. The duplicated command may be inserted substantially adjacent to the original command. Furthermore, the controller may reference the printer specific commands and modify one or more subsequent printing passes to essentially remove the printer specific commands associated with the multi-dotted pixel. In this manner, the printer specific commands may be modified. To reduce the impact of slew decap while producing a rendered pixel, each color utilized to produce the rendered pixel may be multi-dotted. Alternatively, any color not fired within the MSDV may be multi-dotted.

Additionally in step 740, the nozzle may be fired multiple times at the pixel location based on the modified nozzle fire command. In one form, following the multi-dotting, the method may return to the idle step. In another form, in a manner similar to the method 600, the controller may reference the LUT and the printer specific commands to determine if a plurality of pixel are to be multi-dotted. Based on the LUT and the printer specific commands, a plurality of pixels may be multi-dotted. Following the step 740, the method 700 ay return to the idle step.

While the slew decap time is mentioned, due to the fact that essentially all printer movements are carefully orchestrated, a slew decap distance directly corresponding to the slew decap time may be determined. Thus, slew decap time and distance may be used interchangeably.

The method 700 may improve printing throughput as well as reduce ink usage. For example, the number of printhead servicing events may be reduced, thus, saving time. Furthermore, ink usage may be reduced due to the reduced number of printhead servicing events. Additionally, while printing many elements fairly closely together on a page (e.g., text, etc.), some or all of the elements may be spaced closer together than the MSDV. Thus, only a small minority of pixels may be produced by multi-dotting.

Although a number of embodiments and forms are described, the invention is not limited to one embodiment or form, but rather, some or all of the embodiments and forms may be performed independently or concurrently. In this regard, a form of the method 400, 600 and/or 700 or a combination of forms may be utilized depending on printmode, throughput requirements, print media, etc. Additionally, while multi-dotting a first dot is described in various forms of the invention, depending on a number of factors (e.g., distance traveled, elapsed time since firing, printmode selected, print media used, previous color printed, color to be printed, nozzle condition, etc.), a plurality of pixels may be multi-dotted each time the MSDV is exceeded.

The methods 400, 600 and 700 may exist in a variety of forms both active and inactive. For example, they may exist as software program(s) comprised of program instructions in source code, object code, executable code or other formats. Any of the above may be embodied on a computer readable medium, which include storage devices and signals, in compressed or uncompressed form. Exemplary computer readable storage devices include conventional computer system RAM (random access memory), ROM (read only memory), EPROM (erasable, programmable ROM), EEPROM (electrically erasable, programmable ROM), flash memory, and magnetic or optical disks or tapes. Exemplary computer readable signals, whether modulated using a carrier or not, are signals that a computer system hosting or running the computer program may be configured to access, including signals downloaded through the Internet or other networks. Concrete examples of the foregoing include distribution of the program(s) on a CD ROM or via Internet download. In a sense, the Internet itself, as an abstract entity, is a computer readable medium. The same is true of computer networks in general.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims—and their equivalents—in which all terms are meant in their broadest reasonable sense unless otherwise indicated.

What is claimed is:

1. A method for reducing the impact of slew decap on image quality in a printing system comprising a printhead, the printhead comprising a nozzle configured to fire ink on a print medium, wherein the ink is operable to produce a pixel on the print medium, the method comprising:

producing a first pixel;

determining whether a second pixel will be produced with a different nozzle;

determining whether the second pixel is a different color from the first pixel; and multi-dotting the second pixel in response to determining the second pixel will be produced by the different nozzle and the second pixel is a different color from the first pixel.

2. The method according to claim 1, further comprising:

referencing a look up table;

producing the second pixel by multi-dotting in response to information contained in the look up table.

3. The method according to claim 1, further comprising:

firing a first dot of the multi-dotting slightly ahead of an intended location of the pixel and firing a second dot of the multi-dotting at substantially the intended location of the pixel.

4. The method according to claim 1, further comprising:

firing a first dot of the multi-dotting at substantially an intended location of the pixel and firing a second dot of the multi-dotting slightly behind the intended location of the pixel.

5. The method of claim 1, wherein the step of producing the first pixel comprises multi-dotting the first pixel with the nozzle during a single printing pass, wherein the multi-dotting comprises firing ink multiple times in succession from the nozzle at a pixel location corresponding to the first pixel.

6. The method of claim 5, further comprising:

omitting firing ink into the first pixel with the nozzle during a second printing pass in a multi-pass printing operation.

7. The method of claim 5, further comprising:

firing a first dot of the multi-dotting at substantially an intended location of the first pixel; and firing a second dot of the multi-dotting slightly behind the intended location of the first pixel.

8. The method of claim 5, further comprising:

firing a first dot of the multi-dotting slightly ahead of an intended location of the first pixel; and firing a second dot of the multi-dotting at substantially the intended location of the first pixel.

9. A method for reducing the impact of slew decap on image quality in a printing system comprising a printhead, the printhead comprising a nozzle configured to fire ink on a print medium, wherein the ink is operable to produce a pixel on the print medium, the method comprising:

receiving a nozzle fire command;

determining whether the nozzle has fired within a maximum slew decap value; and producing the pixel by multi-dotting from the nozzle in response to a determination that the nozzle has not fired within the maximum slew decap value.

10. The method according to claim 9, further comprising:

receiving a printmode; and determining the maximum slew decap value based on the printmode.

11. The method according to claim 10, further comprising:

producing a plurality of pixels by multi-dotting from the nozzle based on the printmode.

12. The method according to claim 9, further comprising:

firing a first dot of the multi-dotting slightly ahead of an intended location of the pixel and firing a second dot of the multi-dotting at substantially the intended location of the pixel.

13. The method according to claim 9, further comprising:

firing a first dot of the multi-dotting at substantially an intended location of the pixel and firing a second dot of the multi-dotting slightly behind the intended location of the pixel.

14. A computer readable medium on which is embedded computer software comprising a set of instructions executed by a processing system to perform the method for reducing the impact of slew decap on image quality in a printing system comprising a printhead, the printhead comprising a nozzle configured to fire ink on a print medium, wherein the ink is operable to produce a pixel on the print medium, the method comprising:

producing a first pixel;

determining whether a second pixel will be produced with a different nozzle;

determining whether the second pixel is a different color from the first pixel; and multi-dotting the second pixel in response to determining the second pixel will be produced by the different nozzle and the second pixel is a different color from the first pixel.

15. The computer readable medium according to claim 14, further comprising:

referencing a look up table;

producing the second pixel by multi-dotting in response to information contained in the look up table.

16. The computer readable medium according to claim 14, further comprising:

firing a first dot of the multi-dotting slightly ahead of an intended location of the pixel and firing a second dot of the multi-dotting at substantially the intended location of the pixel.

17. The computer readable medium according to claim 14, further comprising:

firing a first dot of the multi-dotting at substantially an intended location of the pixel and firing a second dot of the multi-dotting slightly behind the intended location of the pixel.

18. The computer readable medium of claim 14, wherein the step of producing the first pixel comprises:

producing the first pixel with the nozzle, the first pixel being produced by multi-dotting during a single printing pass, wherein multi-dotting comprises firing ink multiple times in succession from the nozzle at a pixel location corresponding to the pixel.

19. The computer readable medium of claim 18, further comprising:

omitting firing ink into the first pixel with the nozzle during a second printing pass in a multi-pass printing operation.

20. The computer readable medium of claim 18, further comprising:

firing a first dot of the multi-dotting slightly ahead of an intended location of the first pixel;and firing a second dot of the multi-dotting at substantially the intended location of the first pixel.

21. The computer readable medium of claim 18, further comprising:

firing a first dot of the multi-dotting at substantially an intended location of the first pixel; and firing a second dot of the multi-dotting slightly behind the intended location of the first pixel.

22. A computer readable medium on which is embedded computer software comprising a set of instructions executed by a processing system to perform the method for reducing the impact of slew decap on image quality in a printing system comprising a printhead, the printhead comprising a nozzle configured to fire ink on a print medium, wherein the ink is operable to produce a pixel on the print medium, the method comprising:

receiving a nozzle fire command;

determining whether the nozzle has fired within a maximum slew decap value; and producing the pixel by multi-dotting from the nozzle in response to a determination that the nozzle has not fired within the maximum slew decap value.

23. The computer readable medium according to claim 22, further comprising:

receiving a printmode; and determining the maximum slew decap value based on the printmode.

24. The computer readable medium according to claim 23, further comprising:

producing a plurality of pixels by multi-dotting from the nozzle based on the printmode.

25. The computer readable medium according to claim 22, further comprising:

firing a first dot of the multi-dotting slightly ahead of an intended location of the pixel and firing a second dot of the multi-dotting at substantially the intended location of the pixel.

26. The computer readable medium according to claim 22, further comprising:

firing a first dot of the multi-dotting at substantially an intended location of the pixel and firing a second dot of the multi-dotting slightly behind the intended location of the pixel.

27. An apparatus for operating a printer comprising a printhead, the printhead including a nozzle, the apparatus comprising:

a controller configured to receive a print job;

the controller further configured to modify the print job, wherein the modification includes a command to produce a pixel by multi-dotting during a single printing pass, wherein multi-dotting comprises firing ink multiple times in succession from the nozzle at a pixel location corresponding to the pixel, wherein the controller is further configured to receive a selected printmode and determine a maximum slew decap value in response to the received printmode; and the nozzle being operable to produce the pixel by multi-dotting in response to the modified print job.

28. The apparatus according to claim 27, wherein the controller is further configured to determine whether the nozzle has fired within the maximum slew decap value.

29. A method for reducing the impact of slew decap on image quality in a printing system comprising a printhead, the printhead comprising a nozzle configured to fire ink on a print medium, wherein the, ink is operable to produce a pixel on the print medium, the method comprising:

receiving a command to produce a line in a direction perpendicular to a scan direction of the printhead;

determining whether the nozzle has filed within a maximum slew decap value; and producing a pixel corresponding to the line with the \nozzle, the pixel being produced by multi-dotting during a single printing pass in response to the determination that the nozzle bas not fired within the maximum slew decap value, wherein multi-dotting comprises firing ink multiple times in succession from the nozzle at a pixel location corresponding to the pixel.

30. The method according to claim 29, further comprising:

omitting firing ink into the pixel with the nozzle during a second printing pass in a multi-pass printing operation.

31. The method according to claim 29, further comprising:

firing a first dot of the multi-dotting slightly ahead of an intended location of the pixel and firing a second dot of the multi-dotting at substantially the intended location of the pixel.

32. The method according to claim 29, further comprising:

firing a first dot of the multi-dotting at substantially an intended location of the pixel and firing a second dot of the multi-dotting slightly behind the intended location of the pixel.

33. A computer readable medium on which is embedded computer software comprising a set of instructions executed by a processing system to perform the method for reducing the impact of slew decap on image quality in a printing system comprising a printhead, the printhead comprising a nozzle configured to fire ink on a print medium, wherein the ink is operable to produce a pixel on the print medium, the method comprising:

receiving a command to produce a line in a direction perpendicular to a scan direction of the printhead, determining whether the nozzle has riled within a maximum slew decap value, and producing a pixel corresponding to the line with the nozzle, the pixel being produced by multi-dotting during a single printing pass in response to the determination that the nozzle has not fired within the maximum slew decap value, wherein multi-dotting comprises firing ink multiple times in succession from the nozzle at a pixel location corresponding to the pixel.

34. The computer readable medium of claim 33, the method further comprising:

omitting firing ink into the pixel with the nozzle during a second printing pass in a multi-pass printing operation.

35. The computer readable medium of claim 33, the method further comprising:

firing a first dot of the multi-dotting slightly ahead of an intended location of the pixel and firing a second dot of the multi-dotting at substantially the intended location of the pixel.

36. The computer readable medium of claim 33, method further comprising:

firing a first dot of the multi-dotting at substantially an intended location of the pixel and firing a second dot of the multi-dotting slightly behind the intended location of the pixel.

* * * * *